United States Patent [19]

Garcia

[11] Patent Number: 4,634,114

[45] Date of Patent: Jan. 6, 1987

[54] HAND EXERCISER

[76] Inventor: Luis M. Garcia, 333 Somers Rd., Hampden, Mass. 01036

[21] Appl. No.: 658,993

[22] Filed: Oct. 9, 1984

[51] Int. Cl.[4] ..... A63B 21/02; A63B 21/30

[52] U.S. Cl. ..... 272/67; 272/137; 272/141

[58] Field of Search ..... 272/67, 68, 135, 136, 272/137, 141, 142; 73/379

[56] References Cited

U.S. PATENT DOCUMENTS

| | | | |
|---|---|---|---|
| D. 234,309 | 2/1975 | Buchner | 272/135 X |
| 668,473 | 2/1901 | Yount | 272/68 |
| 688,499 | 12/1901 | Bell | 272/136 |
| 2,205,161 | 6/1940 | Vick | 272/68 |
| 3,442,132 | 5/1969 | De Mare | 73/379 |
| 3,445,109 | 5/1969 | Kolbel | 272/137 |
| 4,226,412 | 10/1980 | Panepinto | 272/68 |
| 4,239,212 | 12/1980 | Hickey | 272/137 X |
| 4,351,527 | 9/1982 | Crisp, Jr. | 272/141 X |

FOREIGN PATENT DOCUMENTS

| | | | |
|---|---|---|---|
| 161282 | 4/1921 | United Kingdom | 272/137 |

*Primary Examiner*—Robert A. Hafer

*Assistant Examiner*—Kathleen J. D'Arrigo

*Attorney, Agent, or Firm*—Leonard S. Michelman

[57] ABSTRACT

A hand exerciser for strengthening the hand includes a plurality of helical spring segments mounted on a unitary cylindrical shaped shaft. The separate springs are locked between a wing nut at one end of the shaft and between the bushing next to the handle which is located at the other end.

Located between the segments of the springs are a plurality of separators and a floating bushing for locking the springs into their predetermined positions.

An inside handle is mounted on the shaft. An outside handle is mounted on the shaft surrounding the inside handle. The inside handle is mounted on the shaft at the end thereof opposite from the wing bolt. The outside handle has an inclined portion for the purpose of maintaining leverage when gripped by the user.

The inside handle is gripped by the fingers of the user and pulled by the thumb and the remaining part of the hand towards the outside handle against the tensions of the plurality of springs. The spring segments are separated by spacers that act as safety devices as well as reducing the cost of manufacture.

10 Claims, 6 Drawing Figures

HAND EXERCISER

BACKGROUND OF INVENTION

1. CATEGORY OF INVENTION

This invention is concerned with a hand exerciser for strengthening the hand of a human being.

2. DESCRIPTION OF THE PRIOR ART

Various articles of manufacture have been conceived to exercise the hand and give to the user strength of the fingers and the thumb as well as to stimulate the muscles and the blood flow in the hand and and the development of the forearm. Reference is made to the following patents which attempt to solve this problem.

U.S. Pat. No. 4,226,412 discloses a double handle mounted on two U-shape mounted members wherein there are tension springs extending laterally between the U-shaped members.

U.S. Pat. No. 1,620,910 discloses a plurality of springs mounted laterally on two parallel members with two handles whereby the inside handle pulls against the tension of the springs toward the fixed handle.

U.S. Pat. No. 689,652 discloses two parallel members with two cross members whereby a plurality of springs are maintained against the cross members. Attached to the structure of the device containing the springs is an inside handle. The inside handle is then pulled toward the outside handle against the tensions of the springs.

U.S. Pat. No. 668,473 discloses a system whereby there is a U-shaped member mounted on two vertical members against a door or a wall. There is a spring mounted on the mounting member with a handle mounted on a shaft containing the spring. The spring on the inside controls the inside handle. The user places his hand on the outside handle and pulls the inside handle against the tension of the unitary spring towards himself.

The above prior art does not disclose the details of structure on the unitary shaft with bushings and separators that prevent buckling of the spring or twisting thereof.

SUMMARY OF THE INVENTION

The band exerciser of the within invention comprises of a single unitary cylindrical shaft connected to an inside handle.

A plurality of spring segments are interspaced between separators and bushings on said single cylindrical unitary shaft. The spring members are locked together by a wing nut on threads at one end of the shaft. The inside handle is mounted on the opposite end of the shaft from the wing nut. Between the inside handle and the springs is mounted an outside handle which surrounds the inside handle.

THE INVENTION

It is an object of the within invention to provide an improved hand exerciser which will be safe in use, simple to assemble and inexpensive to manufacture.

It is another object of the invention to provide a hand exerciser that will not buckle when the user is pulling against the tension of the springs.

It is yet another object of the within invention to provide a hand exerciser that will not rupture under constant use and will be substantially maintenance-free.

DESCRIPTION OF THE PREFERRED EMBODIMENT

The hand exerciser is assembled on a main shaft 1 which is in the shape of a steel axle, cylindrical in shape, and of a predetermined length to support and mount the various components hereinafter described.

Threads 2 are located at one end of the shaft 1.

A wing nut 3 is threaded onto shaft 1 over the threads 2 and locks the various components into position on the shaft 1.

Figure 5:
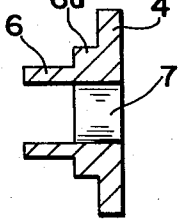
FIG. 5 is a side elevational view in section of the separator shown in FIG. 1 without the spring segment mounted thereon.

FIG. 5 shows in section the double shoulder separator 4 that is located next to the wing nut 3. The separator 4 has an upper shoulder 6 and a lower shoulder 6*a*.

Figure 4:
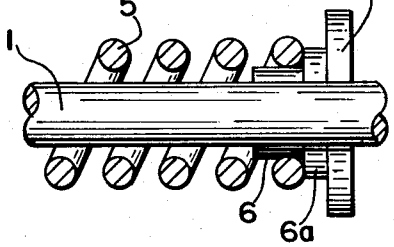
FIG. 4 is a side view in an exploded dimension of a double shoulder separator.
Figure 3:
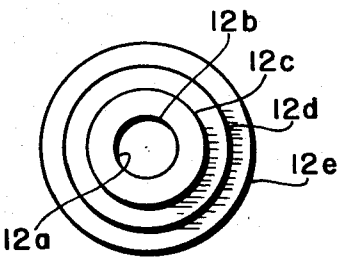
FIG. 3 is an end view of the floating bushing shown in Figure 2.

The upper shoulder 6*a* locks the end of the helical spring segment 5*e* into position (see FIG. 1) while its inside diameter rests on the lower shoulder 6. FIGS. 4 and 5 illustrate the details of this construction. Note that the opening 7 in the double shoulder separator 4 permits the main shaft 1 to pass therethrough.

The helical springs comprise of five separate spring segments 5*a*, 5*b*, 5*c*, 5*d* and 5*e*.

All of the helical spring segments 5*a*, 5*b*, 5*c*, 5*d*, and 5*e* circumscribe the main shaft 1.

Each of said spring segments are separated by the double shoulder separator 4, except spring segments 5*b* and 5*c*.

Located between spring segments 5*b* and 5*c* is the floating bushing 12 which acts as a safety device to prevent the springs from rupturing and buckling.

Figure 2:
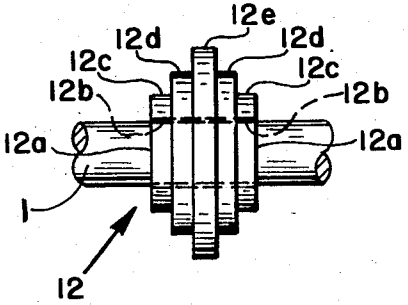
FIG. 2 is a side elevational view of the floating bushing.

FIG. 2 shows in detail the floating bushing 12 which has an opening 12*a* in which the shaft 1 passes through.

The housing 12*b* of the bushing 12 circumscribes the shaft 1. The lower shoulder 12*c* supports the inside surface of the end of the coil of the helical spring segments 5*b* and 5*c*.

The upper surface 12*d* abuts the top surface of the end of the coil of the helical spring segments 5*b* and 5*c*.

The top surface 12*e* of the bushing 12 acts as a safety wall to prevent the various spring segments 5*a*, 5*b*, 5*c*, 5*d* and 5*e*, from buckling over onto each other and rupturing.

In the embodiment disclosed, the floating bushing 12, which may be referred to as a separator bushing, has been inserted three spring segments away from the wing nut 3, between segment 5*b* and 5*c*, and two spring segments away from the outside handle 8. It was discovered that in operation the pulling forces created more closure on the helical spring segments closest to the handle 8, than those closest to the wing nut 3, and the separator floating bushing 12 was strategically located as shown in the drawing and herein described to prevent buckling and rupturing of the spring segments 5b and 5c. However, it is within the spirit and scope of this invention to use the floating bushing 12 at more than one location, and to replace the separator 4 with the bushing 12 at any of said positions.

At the opposite end of the shaft 1 near the handle 8 are threads 9. Mounted on the threads 9 and circumscribing the shaft 1 is an oversized threaded disc nut 9a.

The disk nut 9a can be rotated and positioned on the threads 9 to displace the position of the handle 8 on the shaft 1 by applying pressure and closing the spring segments to contract or releasing the pressure to expand the spring segments whereby the position of the handle on the shaft 1 is adjusted.

The handle 8 has a portion 8a upon which the palm of the hand 13 is placed.

This segment 8a of the handle 8 is at a seven degree (7°) angle from the vertical (90°) to compensate for the gripping by the human hand 13, permitting more ease and comfort.

The finger handle assembly 10 comprises of a grip 10b and a sleeve 10a which has threads on its internal surface for thread mounting on the threads 9 of the shaft 1.

The bushing 11 is located between the spring segment 5a and the handle 8 circumscribing the shaft 1 and acts as a stabilizer between the handle 8 and the spring segment 5a.

Figure 6:
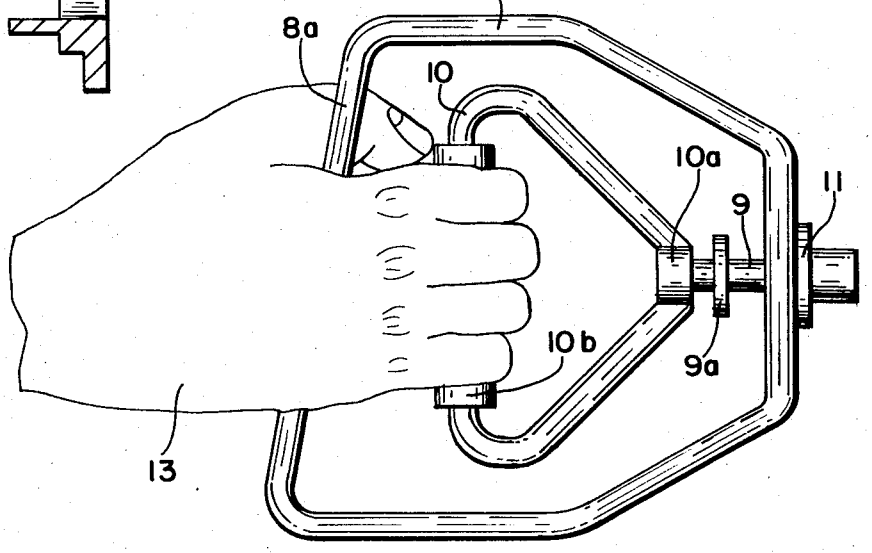
FIG. 6 is an exploded side elevational view of the two handles of the exerciser showing the details of the connection to the main shaft with the user's hand placed in position to operate the same.

In operation, the user places his hand over the handle 8a as shown in FIG. 6. He places his four fingers around the grip 10b on the finger handle 10. He then pulls his fingers towards the handle portion 8a.

Figure 1:
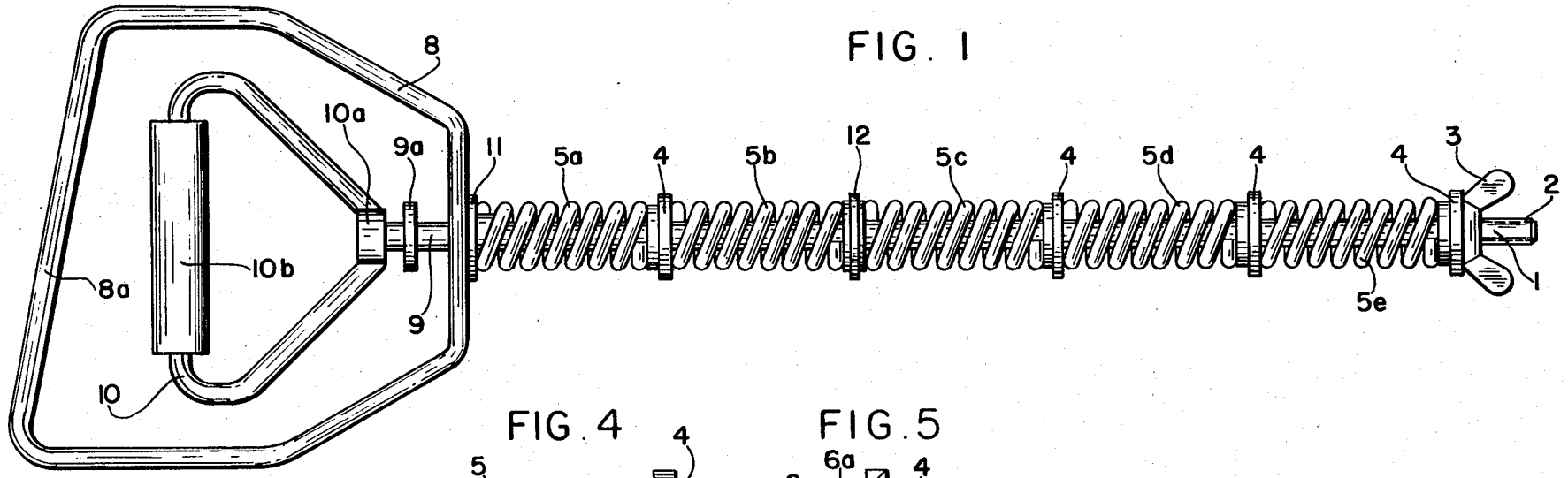
FIG. 1 is a side elevational view of the hand exerciser in complete assembly.

If he has a large hand, he can increase the distance between handle 8a and the grip 10b by rotating the disc adjustment nut 9a towards the bushing 11. Conversely, if he has a small hand, he can decrease the distance by rotating the adjustment nut 9a closer to the sleeve 10a. In FIG. 1, disc nut 9a is shown on shaft 1 away from handle 8 for clarity. However, unless it is loosened a great extent it will in most instances be in contact with handle 8.

By continually moving the finger handle assembly 8 against the tension of the spring segments 5a, 5b, 5c, 5d, and 5e, the user will be exercising his hand and fingers, increasing the strength of his wrist and forearm muscles, and causing increased blood circulation in his fingers, hand and arm.

I claim:

1. A hand exerciser comprising a main shaft, a plurality of helical spring segments circumscribing said shaft, the end of one spring segment being contiguous with the end of the adjoining spring segment, separator means located between each helical spring segment circumscribing said shaft and adapted to receive and abut the ends of each spring segment, a securing means located at one end of said shaft, a means for engaging said securing means to said shaft, an inside handle, an outside handle surrounding the inside handle, said inside handle being in the shape of a triangle and having an opening at the apex thereof, adapted to circumscribe the shaft with threads on its inside surface adapted to mesh with threads on the outside surface of said shaft located at the opposite end of said shaft from the securing means, whereby said inside handle is secured to said shaft, said outside handle being a closed six sided member with the side opposite it's grip portion having a circular opening therein, whereby the said shaft passes therethrough and being freely movable a predetermined distance on said shaft. a means for adjusting the space between the handles on said shaft.

2. A hand exerciser as described in claim 1 wherein the outside handle has a segment that is pitched toward the inside handle from the vertical so that the user can grip the inside handle with comfort.

3. A hand exerciser as described in claim 1 wherein the means for adjusting the position of the handles with respect to each other comprise of a disc nut and threads on said shaft located at the opposite end of the shaft from the securing means whereby the inside handle is stationary and the outside handle can be moved closer or farther away from said inside handle by the adjustment of the disc nut against the tension of the helical spring segments.

4. A hand exerciser as described in claim 2 wherein the means for adjusting the position of the handles with respect to each other comprise of a disc nut and threads on said shaft located at the opposite end of the shaft from the securing means whereby the inside handle is stationary and the outside handle can be moved closer or farther away from said inside handle by the adjustment of the disc nut against the tension of the helical spring segments.

5. A hand exerciser as described in claim 1 having a separator located between the helical spring segments for separating said segments one from the other, said separator having an opening therein for permitting the main shaft 1 to pass therethrough and having a lower shoulder and an upper shoulder on one end thereof for supporting the inside surface and end of a helical spring segment, and having a flat surface opposite from said shoulder for contact with another spring segment.

6. A hand exerciser as described in claim 2 having a separator located between the helical spring segments for separating said segments one from the other, said separator having an opening therein for permitting the main shaft 1 to pass therethrough and having a lower shoulder and an upper shoulder on one end thereof for supporting the inside surface and end of a helical spring segment, and having a flat surface opposite from said shoulder for contact with another spring segment.

7. A hand exerciser as described in claim 3 having a separator located between the helical spring segments for separating said segments one from the other, said separator having an opening therein for permitting the main shaft 1 to pass therethrough and having a lower shoulder and an upper shoulder on one end thereof for supporting the inside surface and end of a helical spring segment, and having a flat surface opposite from said shoulder for contact with another spring segment.

8. A hand exerciser as described in claim 4 having a separator located between the helical spring segments for separating said segments one from the other, said separator having an opening therein for permitting the main shaft 1 to pass therethrough and having a lower shoulder and an upper shoulder on one end thereof for supporting the inside surface and end of a helical spring segment, and having a flat surface opposite from said shoulder for contact with another spring segment.

9. A hand exerciser as described in claim 2, having a floating bushing located between the two middle helical spring segments for separating said segments, said bushing having an opening therein for permitting the main shaft to pass therethrough, and having a lower shoulder and upper shoulder on each end thereof, for supporting the inside surface and end of the helical spring segments between which said spring segments said bushing is located so asto prevent buckling and rupturing of the helical springs when said springs are being placed under a pulling tension by the user of the exerciser.

10. A hand exerciser as described in claim 5, having a floating bushing located between the two middle helical spring segments for separating said segments, said bushing having an opening therein for permitting the main shaft to pass therethrough, and having a lower shoulder and upper shoulder on each end thereof, for supporting the inside surface and end of the helical spring segments between which said spring segments said bushing is located so asto prevent buckling and rupturing of the helical springs when said springs are being placed under a pulling tension by the user of the exerciser.

* * * * *